United States Patent [19]

Sutton

[11] 4,203,576

[45] May 20, 1980

[54] ELEVATING ASSEMBLY FOR AN OFFSHORE PLATFORM

[76] Inventor: John R. Sutton, P.O. Box 32, Beaumont, Tex. 77704

[21] Appl. No.: 923,583

[22] Filed: Jul. 11, 1978

[51] Int. Cl.[2] ..... B66F 7/12

[52] U.S. Cl. ..... 254/89 R; 254/95

[58] Field of Search ..... 254/89 R, 95–97, 254/105, 108; 405/203, 196–199

[56] References Cited

U.S. PATENT DOCUMENTS

| | | | |
|---|---|---|---|
| 3,014,346 | 12/1961 | Small | 405/198 |
| 3,044,269 | 7/1962 | Le Tourneau | 405/198 |
| 3,743,247 | 7/1973 | Willbe et al. | 254/95 X |
| 3,986,368 | 10/1976 | Levington | 254/105 X |
| 4,160,538 | 7/1979 | Armstrong | 254/89 R |

*Primary Examiner*—Robert C. Watson

*Attorney, Agent, or Firm*—Burns, Doane, Swecker & Mathis

[57] ABSTRACT

A jacking assembly for a leg of a jackup offshore platform includes driving assembly and a movable carriage. The driving assembly includes a pair of counterrotating pinions spaced to receive a double-toothed gear rack of the carriage. The driving assembly is attached to the platform so that it can be entirely removed for reuse, if desired. The double-toothed gear rack is pivotally connected to a movable yoke at the upper end which yoke surrounds the leg. Surfaces of the double-edged gear rack are provided with stiffening members that cooperate with the driving assemblies to guide the gear rack during relative movement between the leg and the offshore platform. To selectively connect the carriage with the leg, the movable yoke is provided with a plurality of actuators having pins received by openings at preselected distances along the leg. A locking device is provided on the platform to engage other openings on the leg to fix the relative location of the platform and the leg while the carriage is repositioned. The driving assembly operates at a first speed while setting the leg and raising the offshore platform and moves at a second, higher speed when the carriage is being repositioned. The stroke length of the jacking mechanism is selected such that, with the leg firmly footed in the ocean floor, the platform can be lifted entirely out of the water and above the wave action in a single stroke. The carriage may also include a sleeve surrounding the leg and being slidable relative to the platform.

22 Claims, 17 Drawing Figures

ELEVATING ASSEMBLY FOR AN OFFSHORE PLATFORM

BACKGROUND OF THE INVENTION

This invention relates generally to an offshore platform such as those used in oil exploration and production operations. More specifically, the invention concerns an improved jacking assembly for use with those platforms.

Jackup barges and platforms for use in offshore oil exploration and offshore oil production facilities have long been known. Generally, these platforms are floated into position and slidable legs are extended from the platform to the seabed. With continued extension, the legs ultimately reach a point where the resistance to further penetration of the legs into the seabed exceeds the total weight of the barge. At this time, further attempted relative movement between the legs and the platform causes the platform to be lifted vertically out of the water to an elevated position.

It has been found that the period of time during which the platform moves from a buoyant or floating position to the elevated position, where the platform is a static weight supported solely by the legs engaging the seabed is a particularly important time insofar as the jackup procedure is concerned. During this period of time, the action of wave forces on the platform can exert substantial lateral forces on the legs which, by virtue of their generally open framework, are not ordinarily adversely affected by wave action. This lateral force coupled with the massive inertia of the platform relative to the legs makes it desirable to move through this transition period of wave-platform interaction as briskly as possible.

The currently accepted approach universally used in moving through this transition period provides a gear rack which extends along the entire length of the leg from the top to the bottom, a distance which may be 400 to 500 feet. This gear rack is engaged by a suitable driven pinion which moves the leg relative to the platform. Realizing that each leg is likely to be provided with three or more of such gear racks each fashioned from high tensile strength flame-cut steel, it is apparent that a substantial economic factor is involved in the construction of a jackup platform. Jacking devices of the above described type are fabricated by Marathon-LeFourneau Offshore Company, among others.

Another type of jacking assembly used in offshore platforms includes a yoke selectively engageable with the leg and means for selectively affixing the leg relative to the platform. In one such device (see for example, U.S. Pat. No. 3,517,910 issued to Sutton et al on June 30, 1970), the jacking mechanism includes a ball screw and cooperating shaft to move the yoke relative to the platform. While this jacking mechanism is extremely efficient in terms of the manner in which it lifts a platform, ball screws and ball nuts in the large diameter sizes required for platform lifting operations are expensive and not yet commonly used in the oil exploration and oil production arts. Accordingly, even this type of device is capable of further refinement.

In another version of a jacking assembly, a relatively long ball screw and cooperating ball nut were contemplated in a jackup offshore platform, see U.S. Pat. No. 3,282,565, issued to Sutton on Nov. 1, 1966. That jacking assembly was selected to overcome shortcomings of hydraulic cylinders and provide an alternative to continuously operable rack and pinion systems. That assembly, however, is subject to the same reservations noted above in reference to ball screw arrangements. For those reasons it has not been commercially used.

Another variation on the jacking mechanism is known in which a sleeve surrounds the leg and is rigidly attached to the platform, see U.S. Pat. No. 4,007,914 issued to Sutton on Feb. 15, 1977. In that jacking assembly, a pair of movable yokes are arranged with a rack and pinion mechanism to couple the forces exerted on each yoke with the single yoke engaging the leg. While the jacking mechanism operates with short strokes, the actual jacking operation is effected with hydraulic cylinders. Due to practical limits on the effective stroke of an hydraulic cylinder, there has been industry resistance to adopting that jacking assembly.

With the experience gained heretofore by various oil exploration companies there is now a trend to using jackup type platforms as oil production platforms in offshore oil fields. Acccordingly, these jackup platforms may realistically be expected to be in one position for 20 years or more until the particular oil field is depleted. On the other hand, the jackup type rig is traditionally designed as a portable reuseable type of drilling platform. For example, after an oil exploration well has been completed, the platform may be lowered to the floating condition and the legs then lifted so that the platform can be taken to a new position to again commence oil exploration. Thus, very expensive known jacking assemblies required for lifting the platform with respect to the legs, lead to an unnecessarily high capital expenditure for platforms intended to be used for oil production.

It will therefore be apparent that the need continues to exist for a jacking assembly which overcomes problems of the type discussed above.

BRIEF DESCRIPTION OF THE DRAWINGS

Many objects and advantages of the present invention will be apparent to those skilled in the art when this specification is read in conjunction with the attached drawings wherein like reference numerals have been applied to like elements and wherein:

FIG. 7 is an elevation view in partial cross section of a triangular leg corresponding to the leg illustrated in FIG. 3;

DESCRIPTION OF THE PREFERRED EMBODIMENTS

Figures 1, 8:
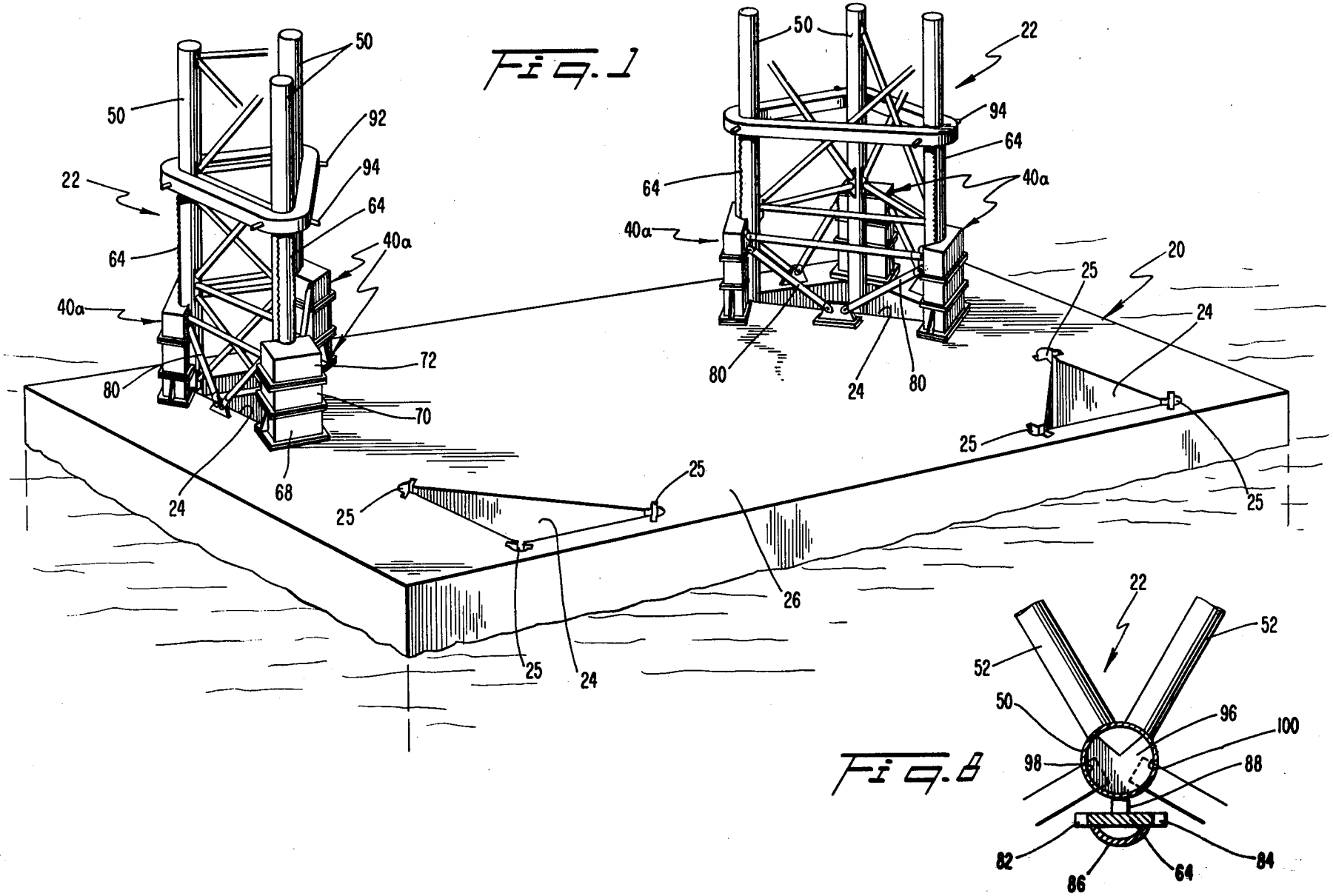
FIG. 1 is a schematic perspective view of jackup offshore platform with two legs removed from the foreground in the interest of clarity.
FIG. 8 is an enlarged partial cross sectional view taken along the line 8—8 of FIG. 7.

In accordance with one aspect of the present invention, an offshore platform is provided with a selectively operable locking assembly to positively fix the relative position between a leg and the platform. To move the offshore platform relative to the leg and vice versa, an improved jacking unit is provided which includes a drive means connected to the surface of the deck so as to be removable. In this fashion, the drive means can be removed from the platform when elevation of the platform has been completed. Accordingly, the drive means can be reused on other platforms, greatly enhancing its economic effectiveness.

The drive means may include a plurality of lifting assemblies spaced circumferentially around the leg. Each lifting assembly has at least two counterrotating pinions which are operable at a first speed in one direction that both lowers the legs and raise the platform. Moreover, the pinions are operable at a second, higher speed to reposition a cooperating carriage assembly selectively connected to the leg. In this manner, rapid repositioning for a successive jacking stroke can be effected.

To permit the legs to be held at any desired position relative to the platform, the drive means includes a braking device to rotationally fix the driving pinions. In this manner, the platform may be held by cooperation between the drive pinions meshed with the gear rack at any desired elevation.

The carriage assembly includes a movable yoke extending substantially around the leg perimeter and having actuatable pins that engage corresponding positioned recesses located at predetermined intervals along the length of the leg. With the pins engaged in the associated recesses, the movable yoke is fixedly positioned with respect to the leg.

The carriage assembly may also include a plurality of double-toothed gear racks extending from the yoke to a corresponding lifting assembly. Each of the tooth portions of a gear rack is engaged by a corresponding one of the pinions in a corresponding lifting assembly. Thus, the forces exerted on the gear rack member by the pinions are uniformly applied so that eccentric loading of the gear rack is avoided.

By selecting the length of the gear rack so that each lifting stroke exceeds the sum of the maximum wave height to be expected plus the draft of the platform when floating, the jacking assembly will raise the platform from the floating position to the elevated position in a single stroke thereby minimizing the time spent in transition period of wave-platform interaction.

To stiffen the gear racks against buckling during the carriage repositioning procedure, one side of each gear rack may be provided with a stiffener that is arcuate in cross section. This stiffening element also cooperates with a conformingly configured channel in the corresponding lifting unit to guide the gear rack during travel of the carriage. In addition, a second stiffener bar may be provided between the gear rack and the leg. This second stiffner also properly spaces the carriage from the associated leg.

To accommodate flexure of the platform during relative movement between the leg and the platform, the lifting assemblies are preferably connected to one another with reinforcing members having pin joint connections. Similarly, the gear racks are attached to the yoke with a pin joint connection to accommodate minor misalignment of the carriage and the leg without introducing compound stresses.

Since the power required to lift a platform is a function of the platform size, additional lifting assemblies may be stacked on one another to provide four, six, or any even number of driving pinions in engagement with the gear racks during the jacking operation.

The carriage may also include a sleeve surrounding the leg and being slidably mounted relative to both the leg and the platform. When lowered, such a sleeve enhances platform stability during deep draft towing. During all phases of jacking operation, such a sleeve increases the bearing surface between the platform and the leg thereby reducing side thrusts on the legs and on the leg wells of the platform. Moreover, during leg jacking-up operations, the stiffness of the sleeve substantially increases the stroke length through which the lifting force may be exerted.

Figure 2:
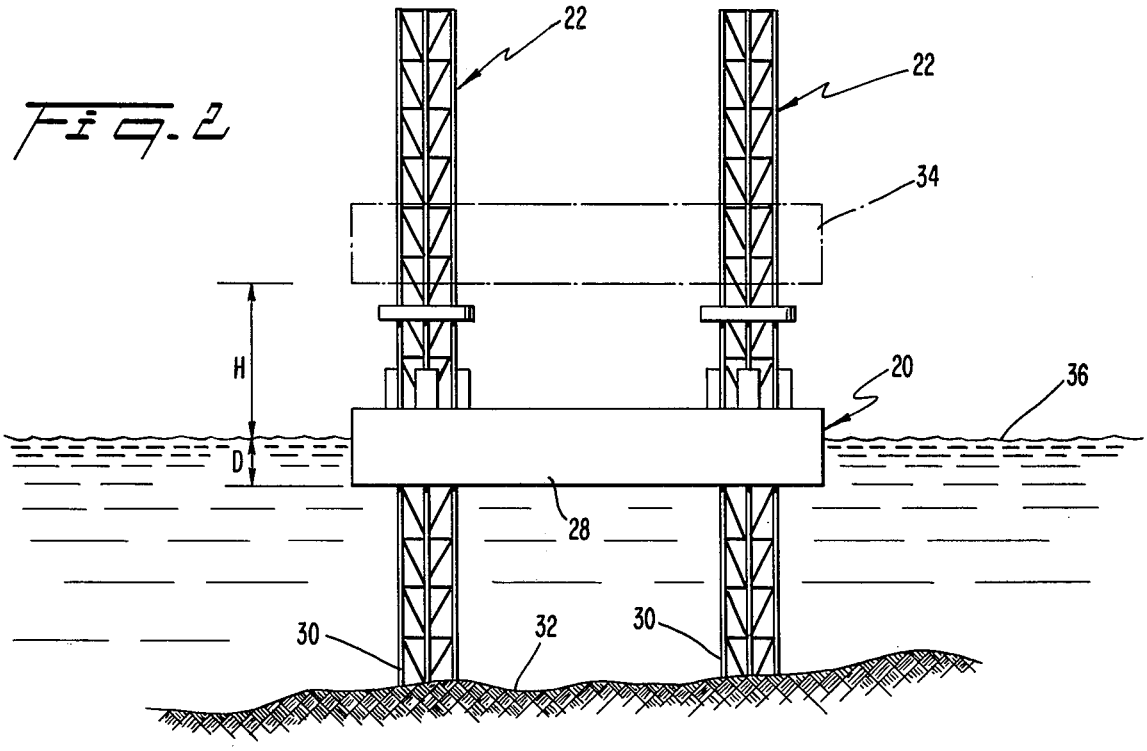
FIG. 2 is a schematic view showing a jackup platform with solid lines in a floating position and with broken lines in an elevated position.

Turning now to FIG. 1, an offshore platform 20 of the jackup type typically includes three or more legs 22 to support the platform 20 when it is elevated above the water surface. Each leg 22 may be as long as 400 to 500 feet and typically comprises an open framework truss member that is slidably received in a corresponding well 24 of the platform 20. In the interest of clarity, two of the legs are not illustrated in the foreground of FIG. 1 so that the wells 24 which receive a leg can be more clearly illustrated. Each well 24 includes a channel 25 aligned with a corresponding jacking assembly. Moreover, each well 24 extends from the deck or upper surface 26 of the platform 20 through to the bottom surface 28 (see FIG. 2) of the platform 20 thereby providing an opening completely therethrough. The peripheral configuration of a well 24 conforms generally to the cross section of a leg to be received thereby.

Each leg 22 includes a ground engaging end 30 which can be lowered into contact with a seabed 32 so as to support the platform 20 in a predetermined offshore location. Depending on the seabed geology and the configuration of the end 30, the end may actually penetrate the seabed until the resistance to further penetration exceeds the weight supported by the leg.

The platform 20 is raised from a floating or buoyant position to an elevated position 34 (shown in broken lines) by jacking assemblies so that the bottom surface 28 of the platform 20 is raised a distance "H" above the water surface 36. This distance "H" is preferably selected to be above the maximum wave height expected from the sea conditions prevailing at the predetermined offshore location. Accordingly, the bottom surface 28 of the platform 20 must be raised a distance corresponding to the sum of the maximum wave height "H" plus the draft "D" of the platform 20 in the buoyant or floating condition.

Figure 3:
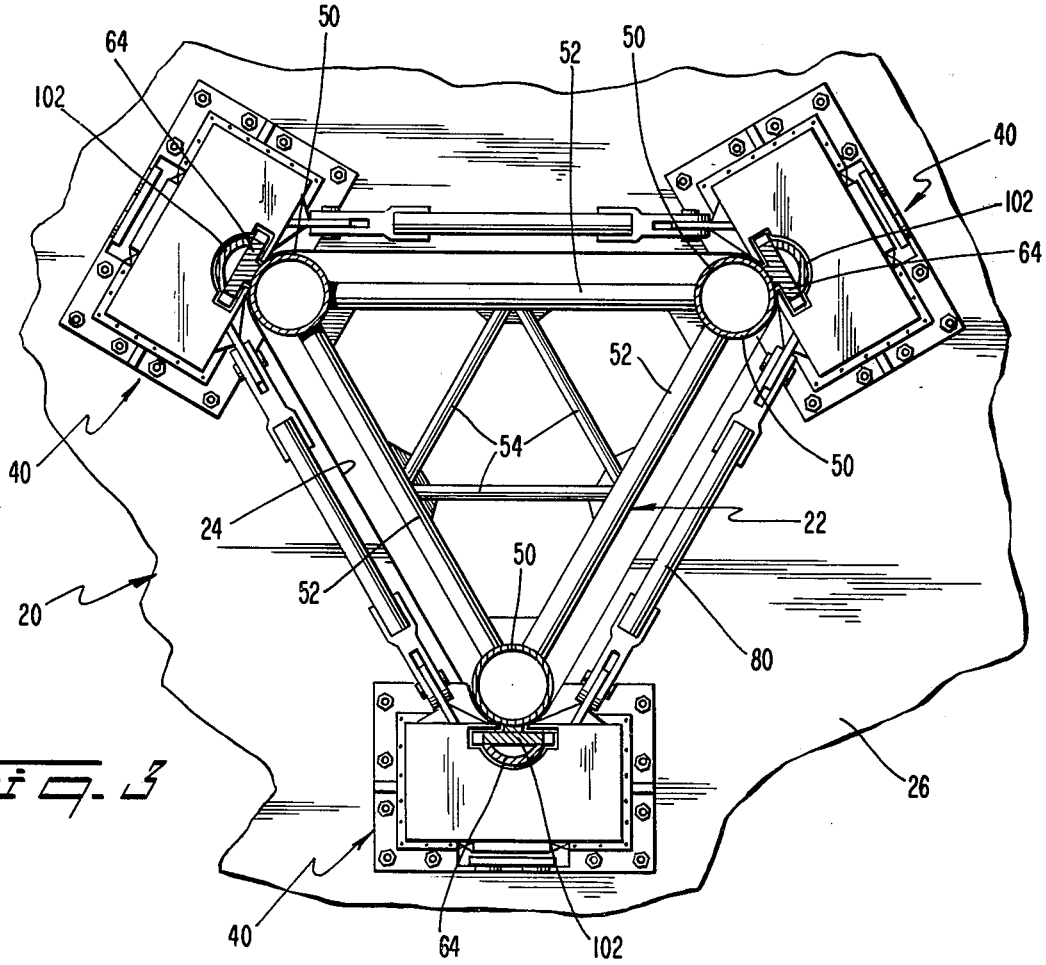
FIG. 3 is a cross sectional view through a triangular leg to illustrate the position of lifting assemblies.

Each leg 22 may be generally triangular in cross section (see FIG. 3) and is received by a well 24 having a conforming contour, i.e., triangular. In order to cause relative movement between the leg 22 and the platform 20, an improved jacking means is provided. This jacking means includes a carriage selectively engagable with the leg and a driving means for the carriage. The driving means may include a lifting means 40 positioned at each apex or corner of the generally triangular cross section of the leg 22.

Figure 4:
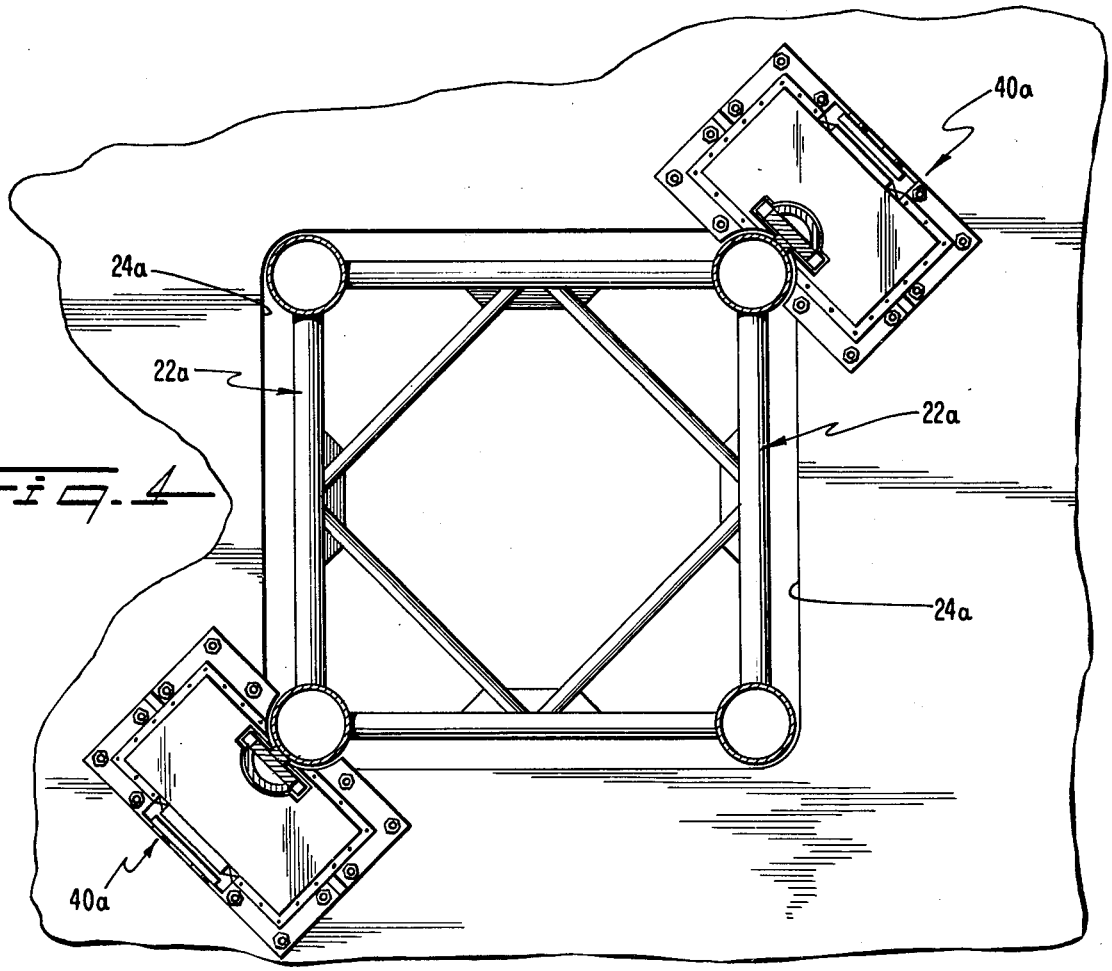
FIG. 4 is a cross-sectional view through a quadrilateral leg illustrating one placement for lifting assemblies.
Figure 5:
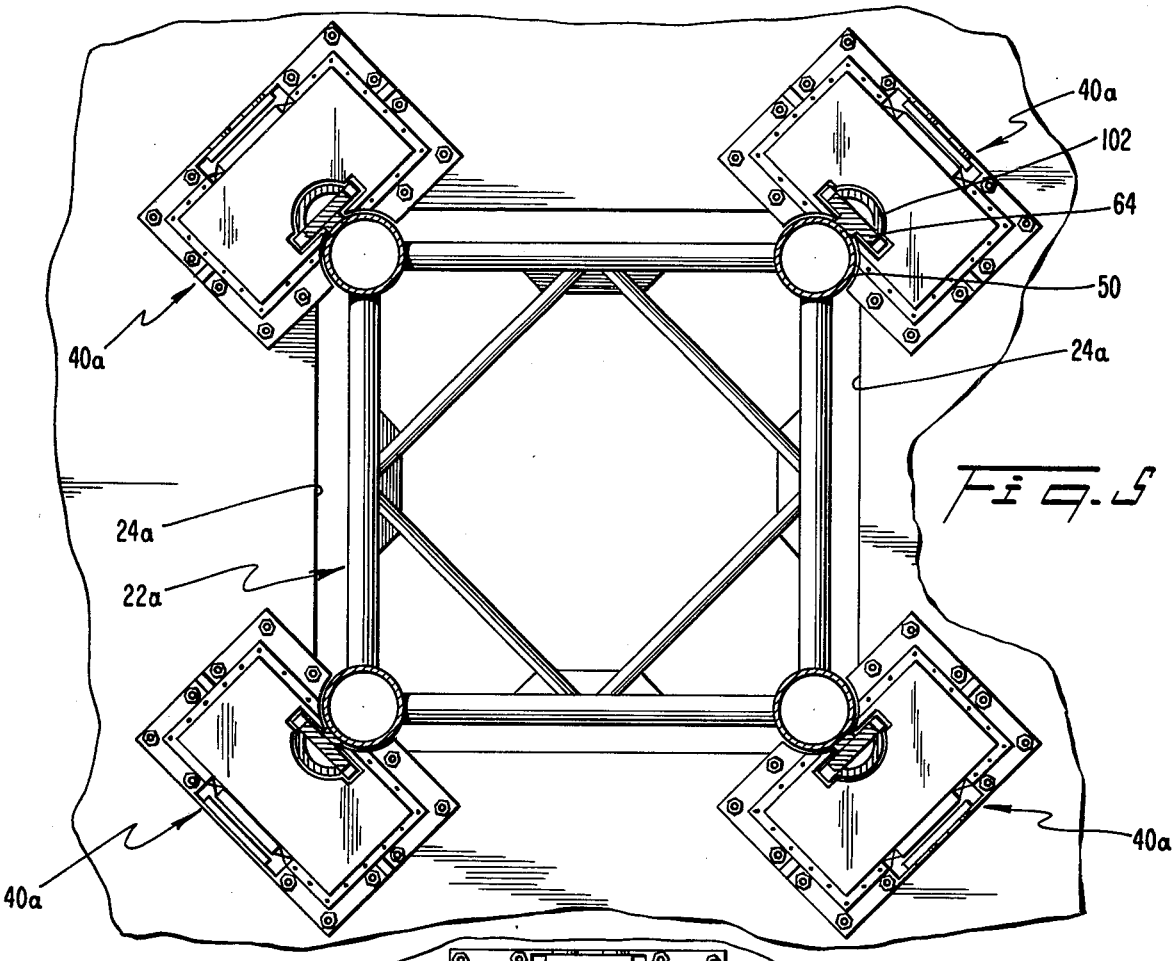
FIG. 5 is a cross-sectional view similar to FIG. 4 illustrating an alternate positioning of lifting assemblies for a quadrilateral leg.
Figure 6:
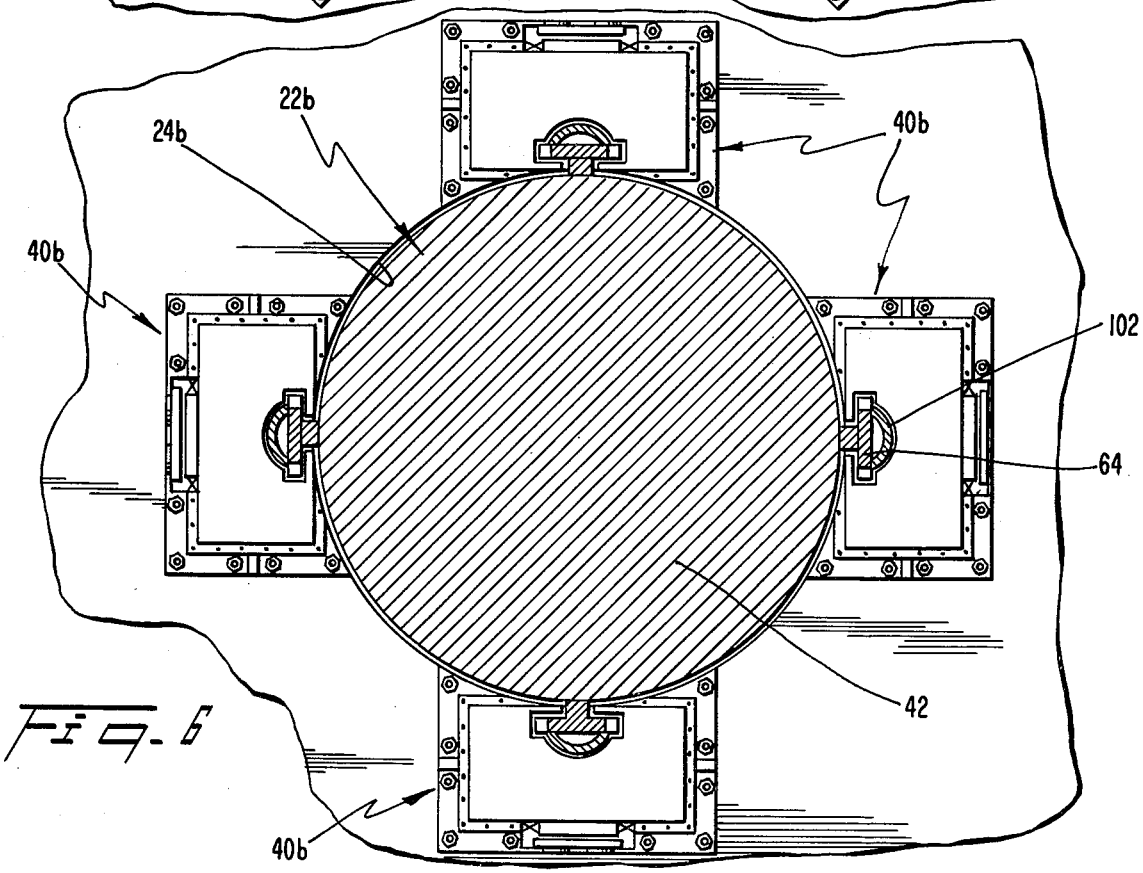
FIG. 6 is a cross-sectional view of a circular leg illustrating a preferred placement for lifting assemblies.
Figure 1:
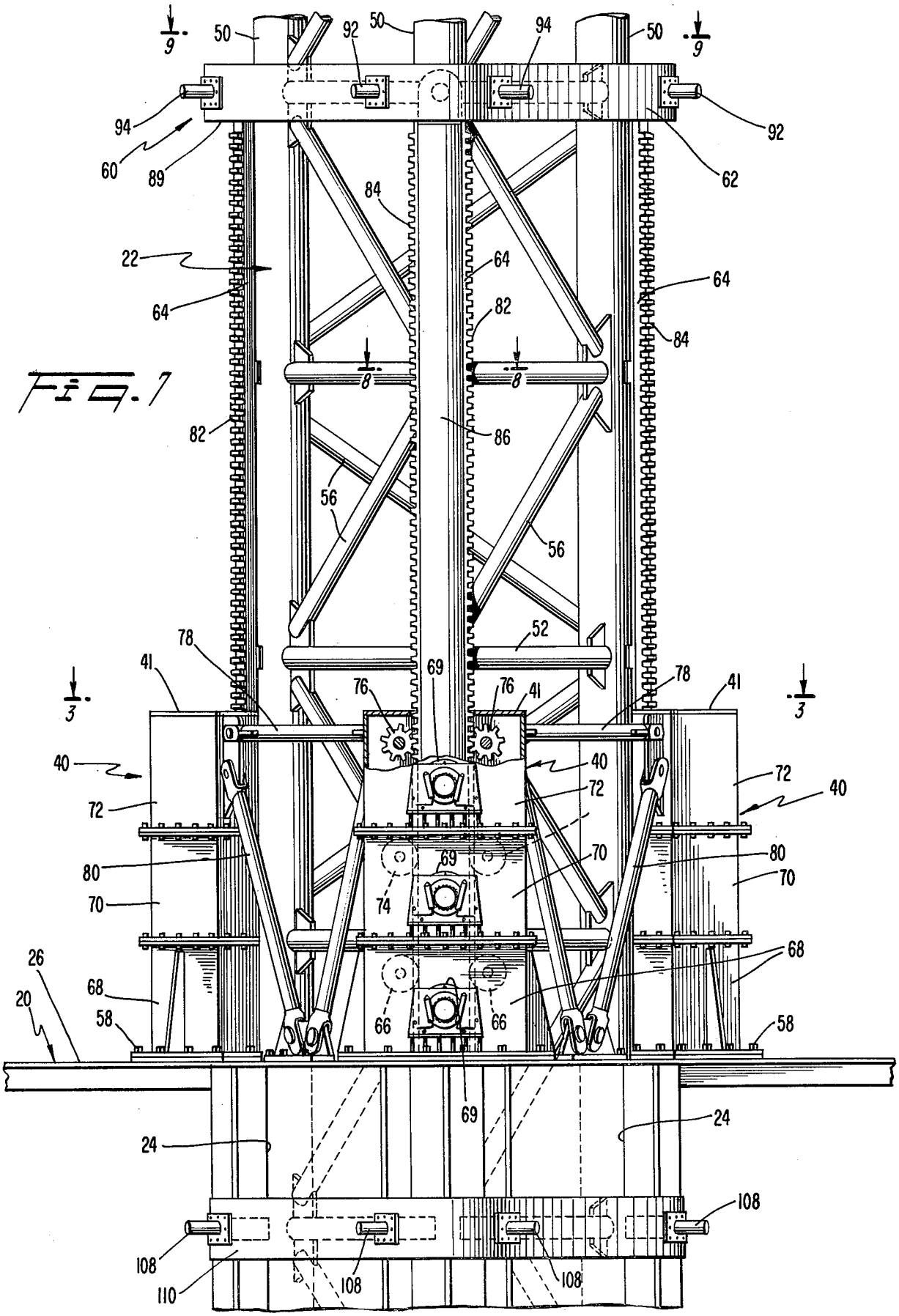

It should be noted at this point that the cross-sectional configuration of the platform leg 22 is not restricted to a generally triangular shape. More specifically, the leg 22 may have a generally quadrilateral cross-sectional configuration (see FIG. 4), such as square, received in a quadrilaterally shaped well **24*a*. A pair of lifting means 40*a* may be positioned on the platform 20 at opposite corners of the well 24*a*. Alternatively, the well 24*a* may be provided with a lifting assembly 40*a* mounted on the platform 20 at each of the four corners (see FIG. 5). For a generally circular leg 22*b* (see FIG. 6) the corresponding well 24*b* is also generally circular. Lifting means 40*b* are preferably located around the perimeter of the well 24*b* at 90° angles with respect to one another, the angle being measured relative to the longitudinal axis 42 of the leg 22*b***. Any polygonal configuration desired may also be used for the leg and still fall within the scope of this invention.

In general, the plurality of lifting means 40 are positioned around the corresponding well (see FIG. 3) substantially equiangularly relative to the axis of the corresponding well. This configuration is adopted so that the lifting means do not exert eccentric resultant forces on the leg. Accordingly, with a triangular leg the lifting units are positioned at each corner or apex of the well 24 (see FIG. 3). With the quadrilateral configuration (see FIG. 4), the lifting assemblies **40*a* are located on opposing corners of the cross section which may be square or rectangular as desired. Where the platform is very heavy, it may be desirable to use the embodiment of FIG. 5 wherein the lifting units are positioned at each of the four corners of the well 24*a*. For the generally circular legs 22*b* (see FIG. 6) any desired number of lifting means (greater than one) may be employed provided that they are equiangularly spaced circumferentially around the well 24*b*. Thus, with the circular leg 22*b***, two, three, four, or more lifting means could be used.

Open framework truss legs 22 (see FIG. 3) typically have many features in common and may be described in connection with the generally triangular legs. Thus, each leg 22 generally has a column 50 at each corner which column extends longitudinally (see FIG. 7) along the entire length of the leg 22. Extending in a generally horizontal plane between adjacent columns 50 are chordwise stiffeners 52 which serve to space the columns 50 relative to one another in the desired cross-sectional orientation as well as to stiffen the truss. Depending upon dimensions of the leg 22 (see FIG. 3), the chordwise stiffeners 52 may themselves be stiffened by additional bracing members 54 each extending essentially between midpoints of the adjacent chordwise stiffeners 52. To strengthen the leg against torsional forces and moments, stiffening braces 56 (see FIG. 7) extend diagonally between adjacent tubular members 50 at the ends of chordwise stiffeners 52.

The jacking assembly of the present invention for effecting relative movement between the leg 22 and the platform 20 will now be discussed in detail. Each leg jacking assembly includes the driving means having the lifting means 40 and a movable carriage 60. Each lifting means 40 is securely mounted to the deck 26 of the platform 20 in a releasable manner, such as by a plurality of bolts 58. The lifting assemblies 40 cooperate with the movable carriage 60 that includes a movable yoke 62 and a plurality of double-toothed rack members 64. Each rack member is connected at one end to the movable yoke 62 and is received by the corresponding lifting means 40.

In order to move the carriage 60 relative to the platform 20, each lifting means 40 includes a pair of pinions 66 which are driven in counterrotating fashion. Each pinion 66 is mounted on a generally horizontal axis, the axes being spaced apart from one another in a generally horizontal plane by a sufficient distance to accommodate the width of the associated gear rack 64.

Each pair of pinions 66 may be driven by an hydraulic motor such as the Series 80 motor fitted with a front bracket bandbrake and manufactured by the Hagglund Company. The motor may be connected to the pinions 66 through suitable conventional reduction gearing. Alternatively, each pinion 66 may be driven by a separate motor. Moreover, the pinions 66 may be driven with one or more electrical motors through suitable conventional reduction gearing.

Preferably, the drive assembly for the pinions 66 is operable in one direction at a first speed during which the pinions 66 climb the associated gear rack 64. This first speed may, for example, translate as a two feet per minute velocity of the gear rack 64. In addition, the drive assembly is also operable in a second direction, opposite to the first direction, at a second speed which substantially exceeds the first speed. Typically, a velocity of the gear rack 64 in the range of five to ten feet per minute is selected for the second speed. In the second speed operation the pinions 66 descend the associated gear rack 64. In this manner, the pinions 66 can quickly raise the movable yoke 62 relative to the deck surface 26.

The bandbrake of the motor provides a further braking means 69 to enable the leg 22 to be stopped at any relative position to the platform 20. Meshed engagement between the pinions and the gear rack 64 permits the platform 20 to essentially hang from the gear rack 64. To assure that the pinions are fixed rotationally when the associated motor stops, holding capacity of the handbrake 69 preferably is double the lifting capacity of the associated motor. Accordingly, when the legs 22 penetrate the seabed, individual legs can be locked at the desired position to maintain the platform deck in a level attitude.

When the offshore platform 20 becomes increasingly large, additional lifting means may be necessary to operate the carriage 60. Accordingly, the lifting means 40 preferably comprises a modular design in which a first section 68 carrying the first pair of pinions 66 is first mounted directly to the deck 26. Additional sections 70, 72 may be connected to the top of the first section 68, each of the additional sections 70, 72 including a pair of counterrotating pinions 74, 76, respectively. In this manner, the requisite lifting capacity for the lifting assemblies 40 may be easily achieved.

From the foregoing discussion, it will be apparent that with the pinions 66 operating in one direction the carriage 60 moves toward the deck 26; whereas, when the pinions 66 are driven in the opposite direction, the carriage moves away from the deck 26.

During lifting of a platform 20 on jackup legs 22, it is not an uncommon occurrence that the platform deck experience some flexure due to settling of one leg relative to another, occasional maladjustments and the like. Such flexure of the deck can exert binding forces between the lifting means 40 and the corresponding gear rack 64. To alleviate this potential difficulty, the lifting means 40 may be interconnected with one another by suitable bracing members 78 the ends of which are provided with pin joint connections. In addition, inclined stiffening braces 80 may extend between the lifting means 40 and the platform deck 26. As with the horizontal stiffeners 78, ends of the inclined stiffeners 80 are also connected with pin joint connections. These pin joint connections permit sufficient flexibility in the mounting of the lifting units 40 to accommodate flexures of the deck 26 such as may be experienced during the platform lifting operations.

Each gear rack 64 is double-toothed in the sense that a gear profile 82, 84 is provided on each exposed edge. Teeth of each gear profile 82, 84 mesh with teeth of the pinions 66, 74, 76. Preferably, the planar extend of each gear rank 64 is oriented to be generally tangential to the cross section of the corresponding column 50 of the leg 22. Typically, the gear rack 64 is flame-cut from high tensile strength steel.

In order to stiffen the gear rack 64 against lateral buckling, the gear rack 64 is provided with a pair of stiffeners. A first stiffener 86 (see FIG. 8) is substantially arcuate in cross sectional configuration and is attached to one surface of the gear rack 64 in a suitable fashion, such as, for example, by welding. The arcuate cross section of the stiffener 86 increases the resistance of the gear rack 64 to bending.

A second stiffener 88 has a generally square cross section and is positioned between the gear rack 64 and the tubular member 50 of the leg 22. This second stiffener 88 is also suitably connected to the gear rack 64, as by welding, and also functions to space the gear rack 64 relative to the leg column 50 during movement of the carriage 60 (see FIG. 7) relative to the leg 22. With the stiffners 86, 88 on each side of the gear rack 64, the gear rack itself is positioned at the approximate neutral axis of the assembly so that bending stresses thereon are minimized.

While the configuration of the gear rack 64 discussed above is the presently preferred configuration, many other configurations are also intended to be within the scope of the invention. For example, an extruded tube with a sufficiently stiff cross section may have gear rack profiles suitably attached to opposite sides for cooperation with the pinions. Such a tube might then be suitably attached to the carriage 60 and would provide potential economic savings. Other approaches for laterally stiffened gear racks are too numerous to mention individually.

Returning briefly to FIG. 3, each of the lifting means 40 is provided with a channel 102 which conforms to the external contour of the gear rack 64 and the stiffeners 86, 88. Accordingly, the channel 102 guides the lower end of corresponding gear rack 64 during relative movement between the lifting means 40 and the carriage 60.

A stroke of the jacking assembly is defined as the distance between the bottom surface 89 of the movable yoke 62 and the top 41 of the lifting means 40. In order to provide a stroke of sufficient length to lift the platform 20 out of the water and to the elevated position 34 (see FIG. 2) in one movement, each gear rack 64 (see FIG. 7) has a length along the leg 22 which substantially exceeds the sum of the distance "H" and the platform draft "D".

Figure 9:
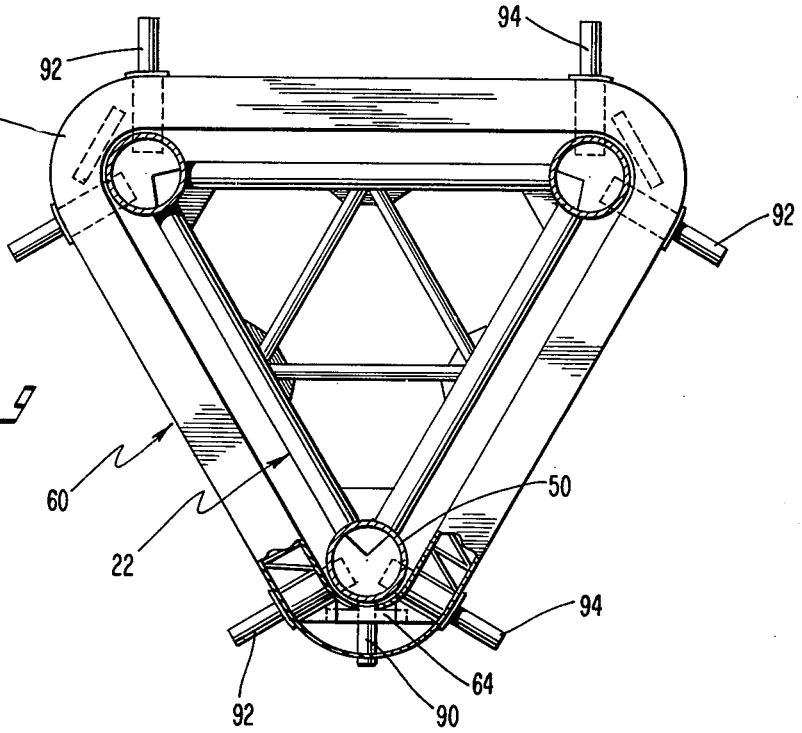
FIG. 9 is a plan view of the lifting yoke with portions broken away to illustrate further detail.

The upper end of each gear rack 64 is connected to the movable yoke 62 (see FIG. 9) with a horizontally extending shear pin 90. With this arrangement between the gear rack 64 and the movable yoke 62, slight inclinations between the top surface of the movable yoke 62 and the deck 26 of the platform 20 can be accommodated without inducing bending stresses in the gear racks 64.

To move the leg 22 when the carriage 60 moves, the movable yoke 62 has means to selectively engage the leg 22 and prevent relative motion therebetween at each corner of the movable yoke 62, a pair of actuatable pins is provided. As these pins are identical, it will suffice to describe in detail the operation of the pins 92, 94 at one corner of the yoke 62.

The actuatable pins 92, 94 are positioned laterally with respect to the connection of the gear rack 64 with the yoke 62, one pin positioned to each side of the gear rack. Each pin is radially aligned with respect to the center of the leg corner column 50 and has an axis which is generally horizontal and transverse of the yoke 62. Within each leg corner column 50 (see FIG. 8) there is a pinhole casting 96 provided with a pair of radially extending recesses 98, 100. A plurality of pinhole castings 96 are provided in each corner column 50, the castings 96 being spaced at uniform preselected intervals along the column 50. The pinhole castings 96 of the corner columns 50 are also positioned so as to lie in a plane transverse of the leg 22. Each pinhole casting is suitably secured to the inside of the associated corner column 50 as by welding or any other suitable means.

The recesses 98, 100 of the pin castings 96 are dimensiond so as to accommodate the pins 92, 94 carried by the yoke 62. When each pins 92, 94 of the yoke 62 is engaged with a corresponding recesses 98, 100 of the corresponding column 50, (see FIG. 9), the movable yoke 62 is fixedly positioned relative to the leg 22. Thus, any movement of the movable yoke 62 will be accompanied by a corresponding movement of the leg 22 relative to the platform.

In order to fix the position of the leg 22 with respect to the platform 20 (see FIG. 7) while the carriage 60 is repositioned for a subsequent stroke, a second plurality of actuators is provided on the platform 20. This second plurality of actuators for pins 108 may, if desired, be portions of a second fixed yoke 110 located below the deck 26 and surrounding the leg well 24. The pins 108 of the actuator are also received by the recesses 98, 100 (see FIG. 8) of the pinhole castings 96 in the leg corner columns 50.

While the operation of the jacking device constructed in accordance with this disclosure should now be apparent, it will now be discussed in greater detail in connection with FIG. 7. With the carriage 60 in its uppermost position, the actuators for pins 92, 94 of the movable yoke 60 are engaged such that the pins are received in the cylindrical recesses 98, 100 (see FIG. 8). Thus, the carriage 60 (see FIG. 7) is fixed with respect to the leg 22.

Hydraulic motors of the lifting means 40 are then energized driving the pinions 66, 74, 76 in the first direction and causing the carriage 60 and the attached leg 22 to be drawn toward the deck surface 26. It will be seen that this movement corresponds to lowering the leg 22 from a floating platform 20 as well as to raising the platform 20 on a fixed leg 22.

When the carriage 60 has approximately reached the top of the lifting units 40, the actuators of the second plurality of pins 108 below the deck 26 engage a second set of aligned recesses 98, 100 in different pin castings of the leg 22 thereby locking the position of the leg 22 relative to the platform 20.

The first plurality of pins 92, 94 are then withdrawn from the aligned recesses of the leg corner column 50. Accordingly, the carriage is free to move relative to the leg 22 and the platform 20.

Next, the hydraulic motors of the lifting means 40 are reversed and operate at the second, higher speed to elevate the carriage 60 raising it through a distance corresponding to its stroke and until the actuators 92, 94 are in alignment with another series of recesses 98, 100. When registry between the pins 92, 94 and the recesses is effected, the pins 92, 94 enter the newly aligned recesses, again locking the carriage 60 with respect to the leg 22. The second plurality of pins 108 is then released and the hydraulic motors of the lifting means 40 are started again to draw the movable yoke 60 and the connected leg 22 toward the deck 26. This sequence of operations is continued until the leg 22 is fully extended into engagement with the seabed and the platform 20 has been lifted out of the water and above the height of maximum expected wave action.

During the jacking operation as described thus far, all legs 22 of the platform can be lowered in unison by an operating means. This uniform lowering continues until the lower end of each leg 22 begins penetrating the seabed and encountering resistance. At this time, each leg 22 may be individually controlled by the operating means to accomodate variable leg penetration. With the braking means associated with the hydraulic motors, each leg can be fixed relative to the platform at any necessary position to accomodate the variable penetration; alternatively, the pins of the lower yoke can provide the latching if in an alignable position.

Because of the importance of moving continuously through the transition period from buoyant floating condition of the platform to the elevated position with the legs supporting a deadweight platform, the length of the gear racks 64 is selected so that the stroke effected by the carriage 60 exceeds the maximum expected wave height at the platform location plus the draft of the platform 20 itself. This distance may, for example, be on the order of 40 to 60 feet. In this manner, the barge can be moved promptly from its floating position to its elevated deadweight position in a single stroke.

When the platform is to be used as a drilling rig, the lifting means 40 and the carriage 60 can remain in place. However, when the platform 20 is to serve as a production facility in an offshore oil field, the leg 22 may be welded to the platform 20 so as to become an integral part thereof. Next, the carriage 60 and the lifting units 40 may be removed from the deck 26 and transferred to another platform 20 for reuse resulting in a significant economic saving comparison to existing jackup platforms.

In situations where the jacking assembly is used in an exploration rig, the platform may be lowered and the legs raised by reversing the steps discussed above, the carriage being fixed to the leg as the carriage is raised relative to the platform.

Figure 10:
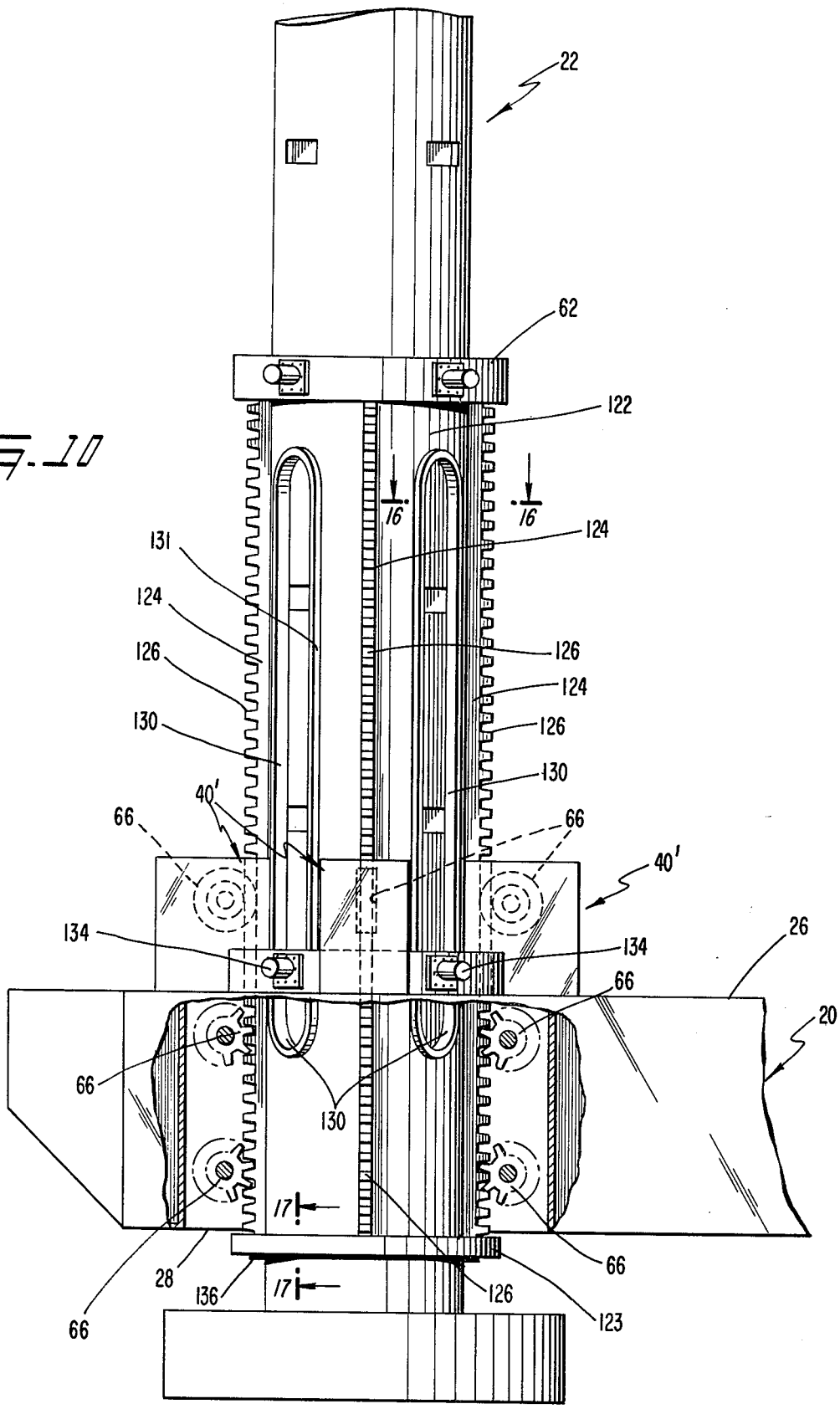
FIG. 10 is an elevation view, similar to FIG. 7, illustrating another embodiment of the present invention.

Referring now to FIG. 10, an alternate embodiment of the carriage 60 is shown which incorporates many of those features discussed above as well as some others to be discussed. The carriage 60 includes a cylindrical sleeve 122 welded with the movable yoke 62. This sleeve 122 surrounds the leg 22, which may be circular, and has a length when fully elevated that extends from the yoke 62 to at least the lowermost pinions 66' of the lifting means 40'. At the lower end of the sleeve 122 is a collar 123 which may function as a stop to limit upward movement of the sleeve 122.

The lifting means 40 may be fitted partially below the deck 26 of the platform 20 so as to improve stability thereof. Moreover, each lifting means 40' includes one or more hydraulic motors with bandbrakes as discussed above.

Figure 11:
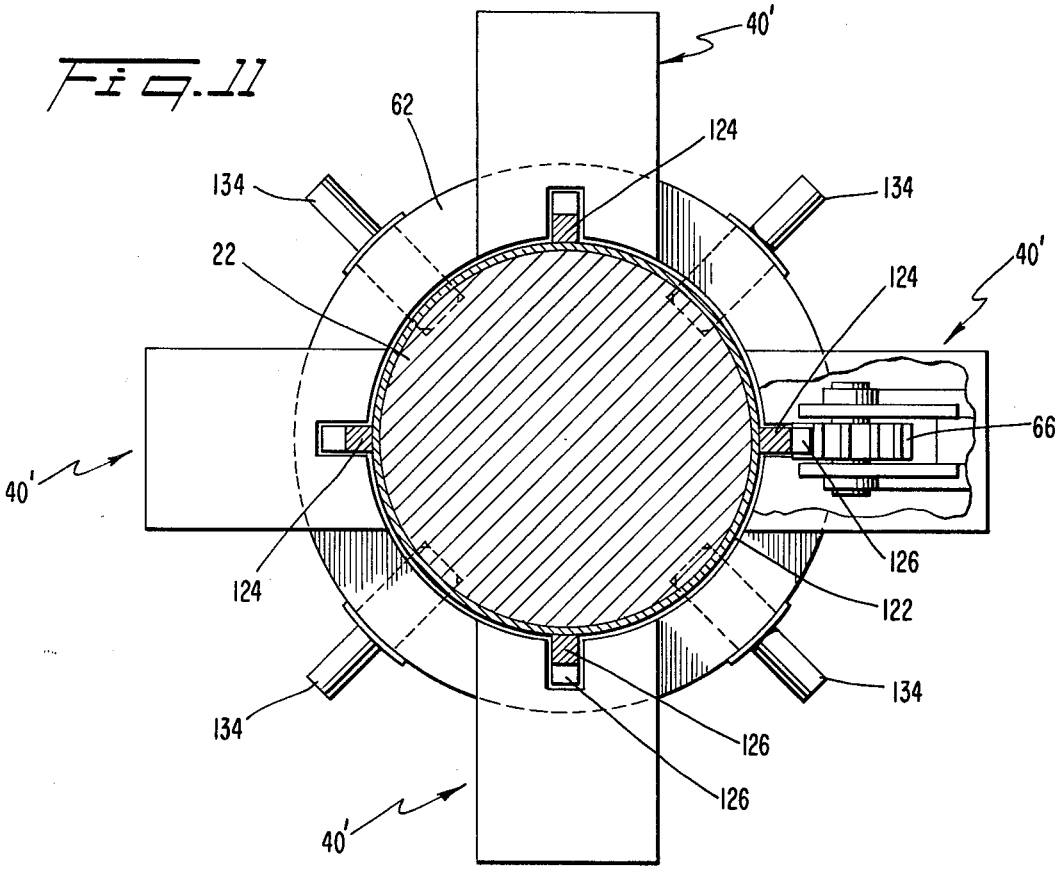
FIG. 11 is a partial cross-sectional view taken along the line 11—11 of FIG. 10.

On the outside of the sleeve 122, a plurality of longitudinally extending rack members 124 are attached, such as by welding, in alignment with the lifting units 40'. Each rack member 124 is substantially perpendicular to the leg 22 (see FIG. 11) and has a tooth profile 126, (see FIG. 10) which meshes with a corresponding pinion so as to be driven thereby. Accordingly, operation of the lifting means 40' causes the carriage 60 including the sleeve 122 and the yoke 62 to raise or lower as in connection with the description above.

To permit the leg 22 to be locked relative to the platform 20 while the carriage 60 is repositioned, the sleeve 122 includes a plurality of longitudinal slots 130. Each slot is aligned with a corresponding actuated pin 134 fixed to the platform 20. Each slot 130 extends from an upper end to a lower end. The upper end is spaced from the yoke 62 so that the actuated pins 134 can be engaged when the movable yoke 62 is in its lowermost position at the top of the lifting means 40'. The lower end is either the bottom end of the sleeve 122 or, if the sleeve 122 extends below the fixed pins 134 when the movable yoke 62 is fully elevated, below the actuator pins 134 in that fully elevated position of the sleeve 122.

Figure 16:
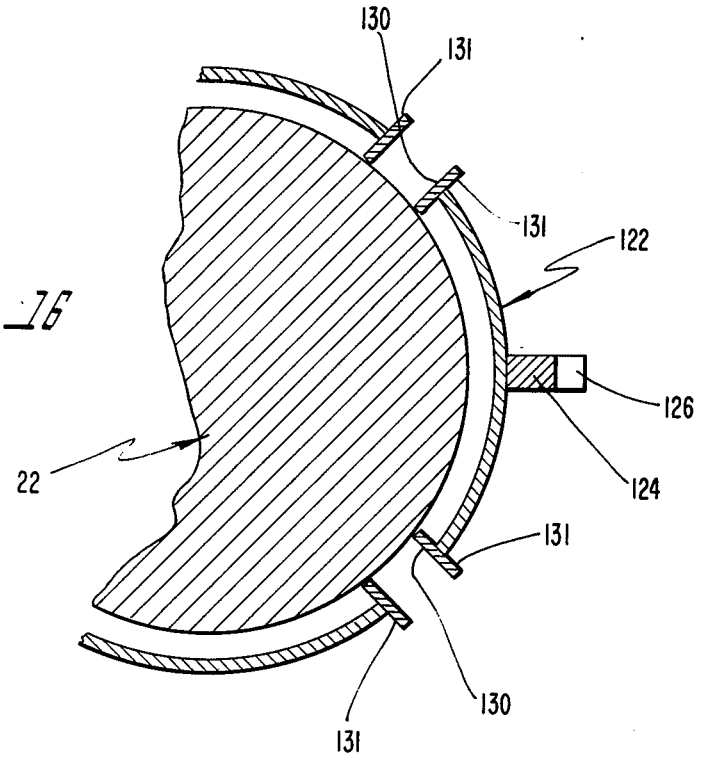
FIG. 16 is a partial cross-sectional view taken along the line 16—16 of FIG. 10.

Each slot 130 (see FIG. 16) may be provided with a pair of spaced stiffeners 131. The inner edge of each stiffener may be spaced from the leg 22 so as to guide the sleeve 122 during movement therealong. If desired, the outer edge of each stiffener 131 may protrude from the sleeve 122. The stiffeners 131 facing each slot 130 serve to increase rigidity of the sleeve adjacent to the slot and thereby accomodate for the presence of the slot.

Figure 17:
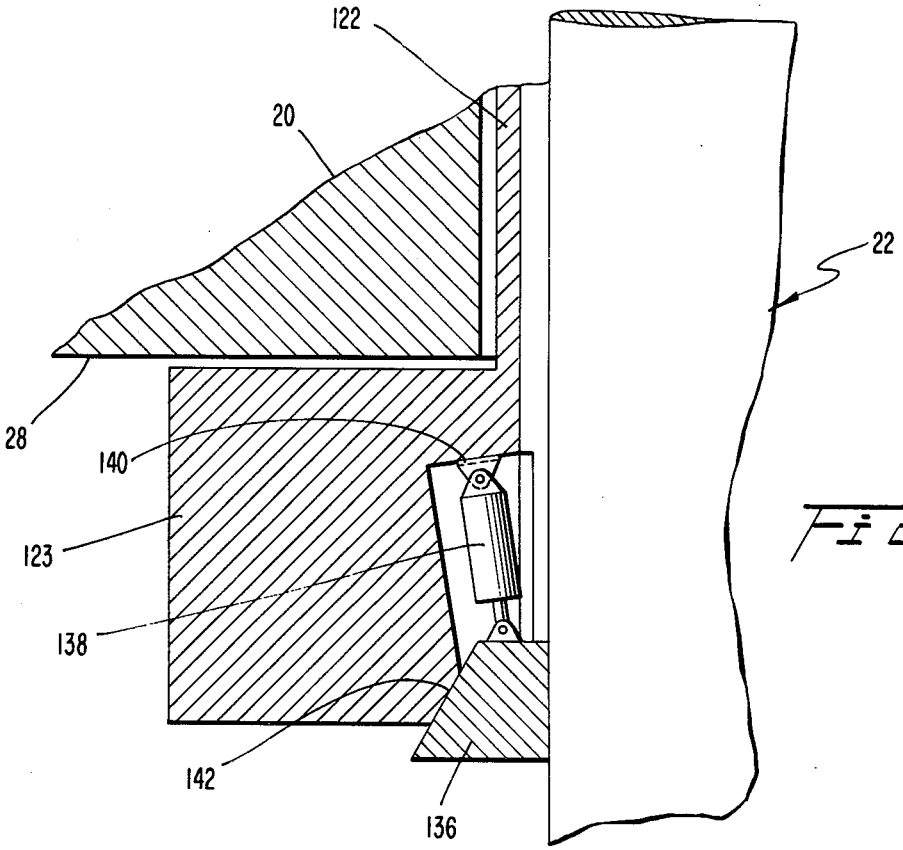
FIG. 17 is a partial cross-sectional view taken along the line 17—17 of FIG. 10.

At the lower end of the sleeve 122, the colar 123 may be provided with an additional locking means (see FIG. 17) to center the leg and secure it to the carriage. In this connection, a plurality of circumferentially spaced cams 136 are positioned on the collar 123 adjacent to the leg. A suitable device, such as an hydraulic cylinder 138, is connected to each cam 136 and to the collar 123 in a recess 140 thereof. Each cam 136 cooperates with an inclined mating surface 142 of the collar to wedge itself aganst the leg 22 in response to movement of the cam caused by the cylinder 138. However, when the sleeve 122 is moved relative to the leg 22, the cams 136 are automatically released by friction forces acting between the leg and the cams.

Where the leg 22 has a non-circular cross section, a pair of rack members 24 may be attached at each corner and provided with a lifting means 40'. Such an arrangement can enhance the lifting capacity of the jacking mechanism.

Figure 12:
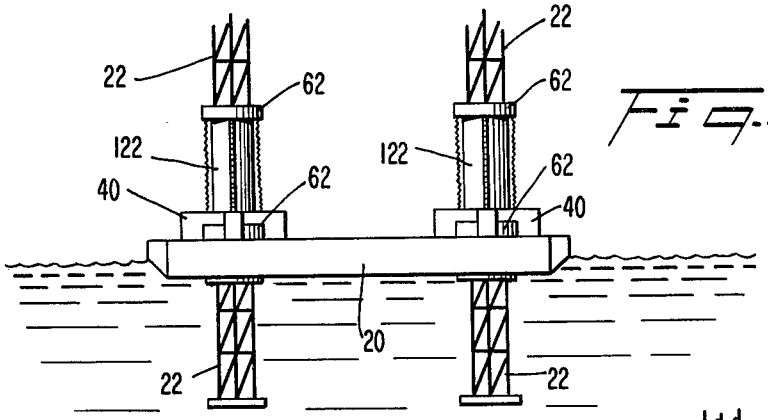
FIG. 12 is a schematic illustration of a platform with a jacking assembly according to FIG. 10 in a shallow draft towing configuration.
Figure 13:
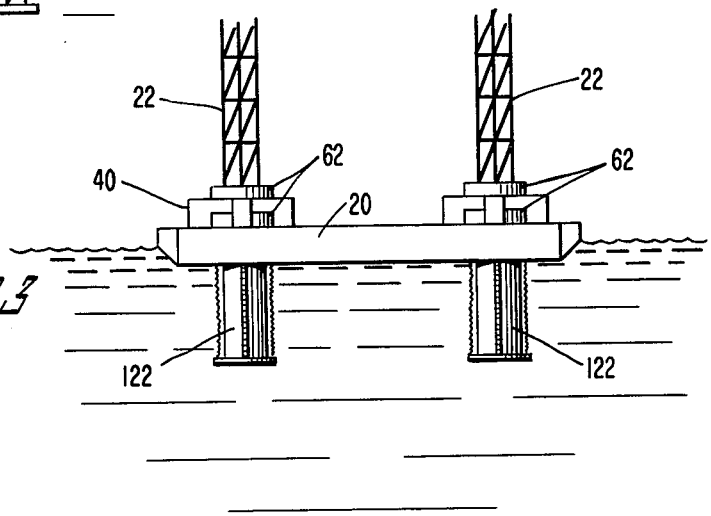
FIG. 13 is a schematic illustration of a platform with a jacking assembly according to FIG. 10 in a deep draft towing configuration.

When the platform 20 moves in shallow water, (see FIG. 12) the sleeve 122 around each leg can be elevated to reduce draft of the vessel. And in the elevated position, each sleeve 122 supports a longer axial portion of the corresponding leg 22 thereby reducing transverse forces applied to that leg 22 in comparison to other jacking assemblies.

Where the platform 20 moves in deep water (see FIG. 13) the collar 122 around each leg may be fully lowered substantially increasing the draft of the platform. However, due to the weight of the sleeves 122, the center of gravity of the platform 20 is lowered resulting in enhanced stability.

Figure 15:
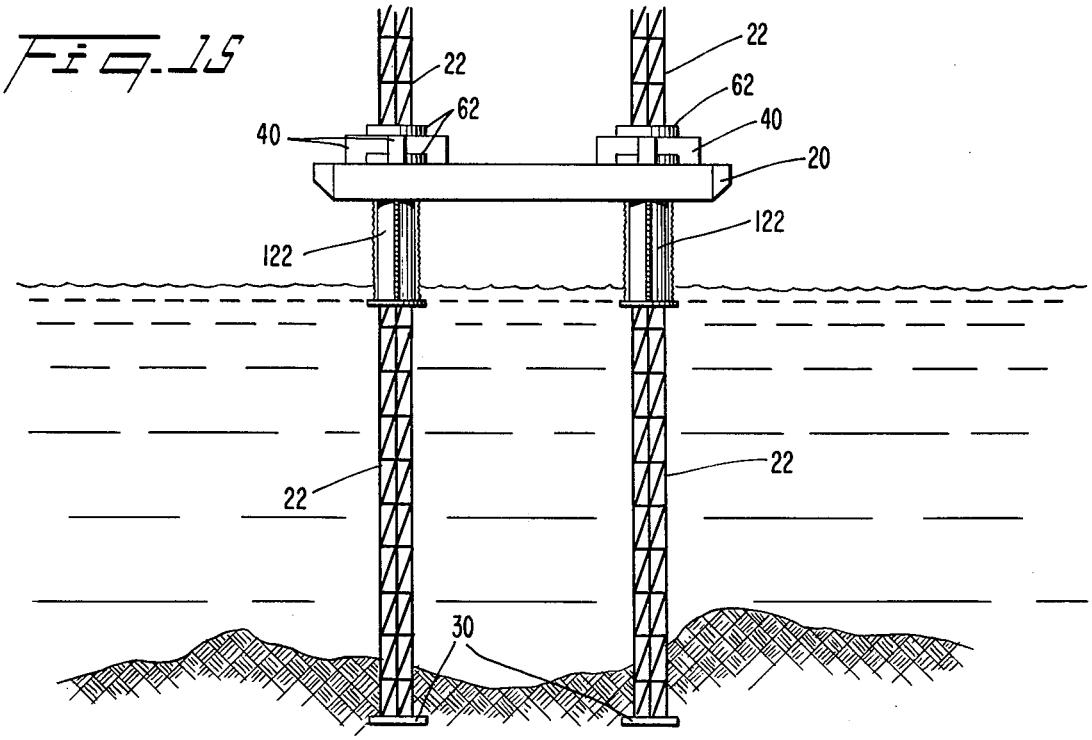
FIG. 15 is a schematic illustration of a platform with a jacking assembly according to FIG. 10 in a platform elevated position.
Figure 14:
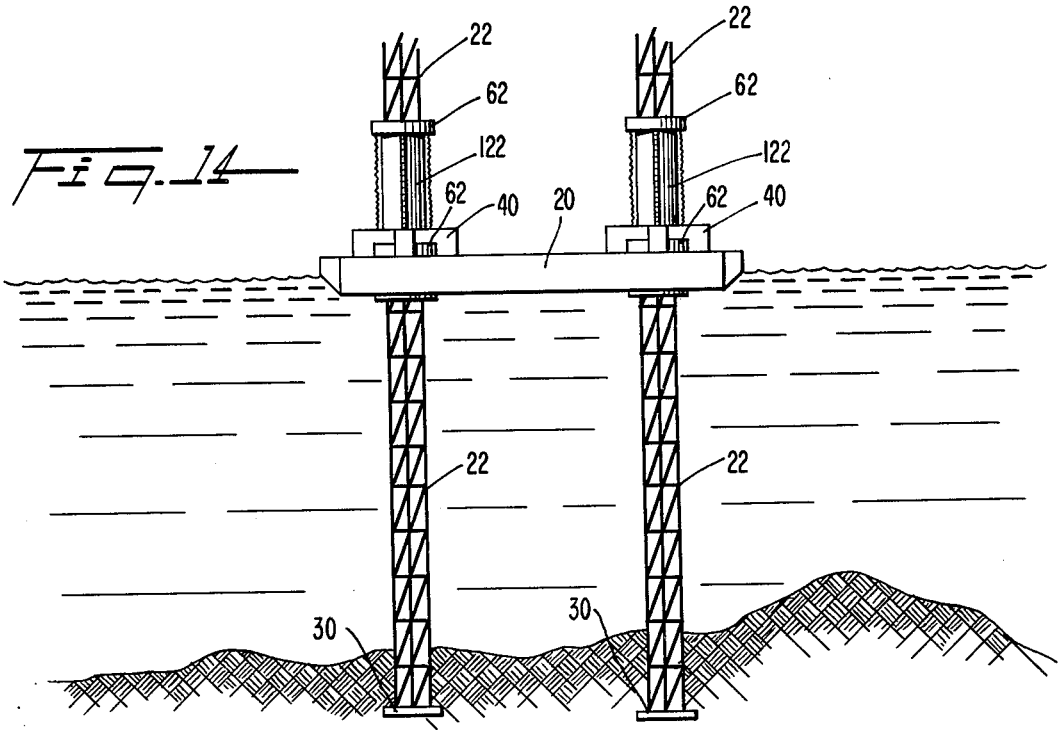
FIG. 14 is a schematic illustration of a platform with a jacking assembly according to FIG. 10 in platform lifting position.

As the platform 20 is raised from the floating position (see FIG. 14) to the elevated position (see FIG. 15), the substantial axial length of the collars reduces the lateral force loading on the legs. Moreover, the actual point at which the legs react these forces remains fixed during this transition period.

When a leg is raised, the suction effect created at an embedded end of the leg reduces the available stroke which can be safely used without buckling the gear racks 64 (see FIG. 7). But, with the sleeve 12 (see FIG. 10) around each leg 12, there is a substantial axial length above the slots 130 which comprises a rigid tubular sleeve. Accordingly, the potential for buckling of the rack members 124 is very greatly reduced in this axial section. Moreover, even in that section of the sleeve 122 having the slots 130, the stiffeners 131 improve the stiffness of the sleeve.

Another aspect of the sleeve 122 pertains to its usefulness as a guiding socket during assembly of leg sections at sea. In this connection, it is noted that conventional legs are difficult to align on a floating platform. Accordingly, by effecting the junction between leg sections within the axial length of the sleeve, the sleeve itself functions as a socket to position to lower end of the leg section being added.

SUMMARY OF MAJOR ADVANTAGES

With the stroke of the jacking assembly selected as outlined above, the transition between the floating configuration and the elevated configuration of the platform is quickly effected with a minimum effect of wave action on the operation.

Similarly, by providing a removable jacking assembly, the jacking assembly may be reused on other platforms thereby increasing its usefulness and reducing the cost of additional platforms.

Moreover, the gear rack need only be supplied in a length on the order of 40 to 100 feet for each corner of the leg. This comparatively short length is in sharp distinction to existing platforms wherein each corner of the leg has a gear rack extending the entire length of 400 to 500 feet. Accordingly, the required length of gear rack is 8 to 25% of existing jackup platforms.

The carriage substantially increases the axial length along the leg through which forces and moments applied by the platform are reacted. Accordingly, the forces and moments are smaller resulting in less likelihood that design limits will be exceeded.

With the carriage lowered, the platform center of gravity is lowered and the stability of the platform against capsizing is increased. As a result, better towing characteristics are exhibited in the platform.

Sharply greater forces may be exerted to pull up a leg from sea bed penetration with a carriage having a sleeve. This improvement is attributable to the rigid nature of the sleeve. Moreover, as the sleeve enhances buckling stiffness, longer strokes of the carriage are permissible in extracting a leg from the sea floor.

Another important advantage resulting from the use of a sleeve in the jacking assembly resides in the improved precision with which the assembly can be designed and constructed. More specifically, with the sleeve attacked to the leg at one end by actuatable pins and wedged against the leg at the other end by the cams, there is no additional tolerance between the leg and the sleeve for which design accomodation must be made. Accordingly, the pinions and the cooperating racks can be designed to closer tolerances. In this manner, the pinions can operate with a greater power transmitting efficiency.

It will now be apparent that there has been provided in accordance with the present invention a new and useful jacking assembly for use in connection with offshore platforms. Moreover, it will be apparent to those skilled in the art that numerous modifications, variations, substitutions, and equivalents may be made for features of the present invention without departing from the spirit and scope thereof. Accordingly, it is expressly intended that all such modifications, variations, substitutions, and equivalents which fall within the spirit and scope of this invention as defined by the appended claims be embraced thereby.

What is claimed is:

1. In an offshore platform of the type having a deck and a plurality of ground engaging legs slidably extending through the deck, an improved jacking means for causing relative movement between the deck and the legs comprising:

lifting means including drive means for causing movement between the deck and a leg, releasably connected to the deck, operable in one direction at a first speed, operable in a second direction at a second speed greater than the first speed, including a pair of counterrotating pinions each having an axis, the axes being spaced from one another in a generally horizontal plane;

rack means for engagement with the pair of pinions having a pair of linear tooth profiles received between the pair of pinions and engaged therewith, extending generally parallel to the leg with a length exceeding the sum of platform draft and maximum wave height, and movable relative to the deck by operation of the drive means;

yoke means for selectively engaging the leg at preselected longitudinal positions therealong, pivotally connected to the rack means and movable therewith; and locking means for fixing the leg relative to the deck, including engagement means for engaging the leg at a second preselected longitudinal position therealong.

2. The offshore platform of claim 1 wherein:

the driven means includes a plurality of lifting means equally spaced circumferentially around the leg, each lifting means being pin connected with each adjacent lifting means to accommodate flexure of the deck.

3. The offshore platform of claim 2 including a plurality of rack means corresponding to the plurality of lifting means and wherein:

each lifting means includes a pair of counterrotating pinions, each pinion having an axis and the pinion axes being spaced from one another in the generally horizontal plane.

4. The offshore platform of claim 3 wherein:

each lifting means includes a second pair of counterrotating pinions engaged with the corresponding rack means, each of the second pair of pinions having an axis, the second pinion axes being spaced from one another in a second generally horizontal plane and in general vertical alignment with a corresponding one of the first pair of pinions.

5. The offshore platform of claim 4 wherein:

each lifting means includes a third pair of counterrotating pinions engaged with the corresponding rack means, each of the third pair of pinions having an axis, the third pinion axes being spaced from one another in a third generally horizontal plane and in general vertical alignment with a corresponding one of the first pair of pinions.

6. The offshore platform of claim 3 wherein:

each lifting means includes a guide slot extending generally vertically therethrough; and each rack means includes a guide member with a cross section conforming to the guide slot of the corresponding lifting means.

7. The offshore platform of claim 6 wherein the guide member includes an arcuate cross section positioned longitudinally of the rack means so as to stiffen the rack means.

8. The offshore platform of claim 6 or claim 7 wherein the guide member includes a longitudinal spacing member positioned between the rack means and the leg so as to stiffen the rack means and to space the rack means from the leg.

9. The offshore platform of claim 2 wherein the lifting means are circumferentially spaced so that the lifting means, in combination, exert a non-eccentric force on the leg.

10. The offshore platform of claim 1 wherein the yoke means includes a plurality of actuatable locking pins which engage corresponding pinholes of the leg.

11. The offshore platform of claim 1 wherein the jacking means includes a plurality of lifting means for each rack means so as to provide increased lifting capacity.

12. The offshore platform of claim 1 or 11 wherein the drive means includes braking means for stopping the drive means with a leg at a predetermined position relative to the deck.

13. The offshore platform of claim 12 wherein the braking means has a holding capacity and the drive means has a lifting capacity, the holding capacity being substantially greater than the lifting capacity so that the braking means can hold the deck on the leg.

14. The offshore platform of claim 12 wherein the lifting means is operable to accommodate differential seabed penetration of individual legs of the platform.

15. The offshore platform of claim 1 wherein the jacking means further includes sleeve means carrying the rack means and the yoke means, the sleeve means being operable to move relative to the deck in response to operation of the drive means.

16. In an offshore platform of the type having a deck and a plurality of ground engaging legs slidably extending through the deck, an improved jacking means for causing relative movement between the deck and the legs comprising:

lifting means including drive means for causing movement between the deck and a leg, releasably connected to the deck, operable in one direction of a first speed, operable in a second direction at a second speed greater than the first speed, including at least one pinion rotatable about a horizontal axis and driven by the drive means;

rack means for engagement with the pinion, having a linear tooth profile, extending generally parallel to the leg with a length exceeding the sum of platform draft and maximum wave height but substantially less than the length of a leg, and movable relative to the deck by operation of the drive means;

yoke means for selectively engaging the leg at preselected longitudinal positions therealong, connected to the rack means and movable therewith; and locking means for fixing the leg relative to the deck, including engagement means for engaging the leg at a second preselected longitudinal position therealong.

17. The offshore platform of claim 16 wherein the jacking means further includes sleeve means carrying the rack means and the yoke means, the sleeve means being operable to move the leg relative to the deck in response to operation of the drive means.

18. The offshore platform of claim 17 wherein the rack means comprises a plurality of single edge gear racks spaced around the sleeve means and extending perpendicularly with respect thereto.

19. The offshore platform of claim 17 wherein a sleeve means is provided for each platform leg.

20. The offshore platform of claim 17 wherein the sleeve means provides a socket in which leg sections can be connected.

21. The offshore platform of claim 17 wherein leg lock means is provided for securing the sleeve means to the leg.

22. The offshore platform of claim 21 wherein the leg lock means includes a wedge positioned between the leg and the sleeve means and a wedge actuator connected to the sleeve means and the wedge, the wedge being automatically released by downward movement of the leg relative to the sleeve means.

* * * * *